US012624460B2

(12) United States Patent
Chrysler et al.

(10) Patent No.: US 12,624,460 B2
(45) **Date of Patent: *May 12, 2026**

(54) SYSTEM AND METHOD FOR MAKING GREEN HYDROGEN

(71) Applicant: Power & Concepts, LLC, Davie, FL (US)

(72) Inventors: Richard Chrysler, Davie, FL (US); Marlon Ekhoff, Grant Park, IL (US)

(73) Assignee: HYDROMICS LLC, Davie, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/316,704

(22) Filed: Sep. 2, 2025

(65) Prior Publication Data

US 2026/0002268 A1 Jan. 1, 2026

Related U.S. Application Data

(63) Continuation of application No. 18/422,842, filed on Jan. 25, 2024, which is a continuation-in-part of application No. 18/202,150, filed on May 25, 2023.

(51) Int. Cl.

| | |
|---|---|
| ***C25B 1/04*** | (2021.01) |
| ***C25B 1/50*** | (2021.01) |
| ***C25B 15/02*** | (2021.01) |

(52) U.S. Cl.

CPC ..... *C25B 1/04* (2013.01); *C25B 1/50* (2021.01); *C25B 15/02* (2013.01)

(58) Field of Classification Search

CPC ..... C25B 1/04; C25B 1/50; C25B 15/02

See application file for complete search history.

(56) References Cited

U.S. PATENT DOCUMENTS 3,410,770 A 11/1968 Buechler
4,113,601 A * 9/1978 Spirig ..... C25B 1/04 204/272

(Continued)

FOREIGN PATENT DOCUMENTS

EP 2433902 3/2012
EP 3907181 11/2021

(Continued)

OTHER PUBLICATIONS

Website New Atlas, https://newatlas.com/energy/hydrogen-sound-vibration-electrolysisl, High-frequency sound waves make electrolyzers produce 14× more hydrogen, Dated Dec. 13, 2022, Retrieved from internet Sep. 4, 2025, 12 pgs.

(Continued)

*Primary Examiner* — Bryan D. Ripa

(74) *Attorney, Agent, or Firm* — Brooks Kushman P.C.

(57) ABSTRACT

A system and method of making hydrogen from water. A reaction vessel is provided with an outer shell, a central shaft, and concentric inner tubes separated by annular spaces. Water is delivered to the annular spaces by a water pump through an inlet defined in the reaction vessel. The water courses along a tortuous flow path. That path begins at an inner annular space around a central shaft. It ends at an outer annular space. The water emerges from the reaction vessel through an outlet associated with a manifold. A vibratory stimulus is applied to the reaction vessel and water. Water molecules are dissociated into hydrogen molecules and oxygen atoms. These reaction products are delivered through the manifold along an effluent flow path to a receiving pressure vessel before deployment to a sub-assembly for harnessing clean energy.

9 Claims, 3 Drawing Sheets

(56) References Cited

U.S. PATENT DOCUMENTS

| | | | | |
|---|---|---|---|---|
| 7,763,085 | B2 | 7/2010 | Kenefake et al. | |
| 7,892,304 | B2 | 2/2011 | Hajiaghajani | |
| 11,291,972 | B2 | 4/2022 | Davis | |
| 2010/0236921 | A1* | 9/2010 | Yang | C25B 1/04 204/264 |
| 2010/0236938 | A1* | 9/2010 | Braught | C25B 1/04 123/3 |
| 2012/0058405 | A1 | 3/2012 | Kirchoff et al. | |
| 2012/0222954 | A1 | 9/2012 | Lothring | |
| 2014/0261252 | A1* | 9/2014 | Kerstiens | C25B 13/02 204/278 |
| 2015/0114832 | A1 | 4/2015 | Nicholson et al. | |
| 2016/0330968 | A1 | 11/2016 | Owens et al. | |
| 2017/0275160 | A1 | 9/2017 | Carter et al. | |
| 2022/0145479 | A1 | 5/2022 | Seymour et al. | |

FOREIGN PATENT DOCUMENTS

| | | | |
|---|---|---|---|
| GB | 2634506 | A | 4/2025 |
| IN | 202311085838 | A | 12/2025 |
| KR | 101750308 | B1 | 6/2017 |
| PE | 20211530 | | 8/2021 |
| WO | 2020115712 | A1 | 6/2020 |
| WO | 2020/0244808 | | 12/2020 |

OTHER PUBLICATIONS

Website: Advanced Energy Materials, https://advanced.onlinelibrary.wiley.com/doi/10.1002/aenm.202203164, Acoustically-Induced Water Frustration for Enhanced Hydrogen Evolution Reaction in Neutral Electrolytes, Dated: Dec. 4, 2022, Retrieved from internet Sep. 4, 2025, 18 pgs.

Website: Alternative Fuels Data Center:Alternative Fueling Station Locator, https://afdc.energy.gov/stations/#/find/nearest?fuel=HY&lpg_secondary=true&country=US&hy_nonretail=true, Retrieved from internet Sep. 4, 2025, 2 pgs.

Website: Use of hydrogen—U.S. Energy Information Administration (EIA), www.eia.gov/energyexplained/hydrogen/use-of-hydrogen.php, Dated: June 21, 2024, Retrieved from internet Sep. 4, 2025, 3 pgs.

* cited by examiner

SYSTEM AND METHOD FOR MAKING GREEN HYDROGEN

CROSS REFERENCE TO RELATED APPLICATION

This application is a continuation of U.S. application Ser. No. 18/422,842 filed Jan. 25, 2024, which is a continuation-in-part of U.S. application Ser. No. 18/202,150 filed May 25, 2023, the disclosures of which are hereby incorporated in their entirety by reference herein.

TECHNICAL FIELD

This disclosure lies in the field of making hydrogen gas on demand from an aqueous solution that is subjected to electrical energy and a vibrational disturbance.

BACKGROUND

The quest for low carbon emissions has made hydrogen an attractive source of energy because it is found in large quantities, mainly in the form of water. When used as a fuel, hydrogen produces water vapor, making it a clean energy source.

Hydrogen can be produced from renewable sources such as solar, wind, and hydropower. But the sun does not always shine, and the wind may not blow as desired. Overall, hydrogen has the potential to be a key component in a sustainable energy future, as it is a clean, efficient, and versatile energy source that can be produced from renewable sources.

In practice, hydrogen gas is difficult to store compactly and efficiently because it has a very low density. This means that a large amount of space is needed to store even a small amount of hydrogen. Because hydrogen gas is a collection of small molecules, it can easily leak through minute gaps in storage containers, valves, or pipes. This can result in hydrogen loss, waste, and potential danger because hydrogen is flammable.

To meet spatial constraints, hydrogen gas must often be stored at high pressures to achieve the required density before use. Such high pressures require storage containers to be heavier and are thus expensive to manufacture.

Another adverse consequence of hydrogen storage is embrittlement. It is known that hydrogen can cause embrittlement in metals, making it difficult to store hydrogen safely in metal containers for long periods of time.

Against this backdrop, it would be desirable to have a system and method to make hydrogen gas on-demand, thereby minimizing or eliminating the need to store hydrogen between its production and use.

Further, it would be desirable to make hydrogen using a system that is relatively compact and if necessary, readily transportable.

Of particular interest is green hydrogen. Green hydrogen is hydrogen gas resulting from water splitting into hydrogen and oxygen, conventionally using electricity and electrolysis. The term "green" refers to the fact that the production of hydrogen does not produce any greenhouse gas emissions. Greenhouse gases are said to negatively impact the environment when their concentrations in the atmosphere are excessive. Such gases trap heat from the sun, which causes the Earth's temperature to increase. This is thought to lead to changes in climate patterns and rising sea levels, more frequent and intense heat waves, droughts, floods, and extreme weather events.

Making green hydrogen is a promising alternative to traditional methods of producing hydrogen, which typically rely on fossil fuels and can contribute to climate change.

Prior art electrolysis involves the decomposition of water by passing a low-voltage current through liquid water to produce hydrogen and oxygen, which can be burned in a combustion engine or fed into a fuel cell to generate energy. Conventional electrolysis systems require electrolytes (e.g., sodium hydroxide or sulfuric acid) added to the water. Then an electrical current is passed through the water until enough energy is supplied to dissociate the hydrogen ions from the oxygen ions. Oxygen ions are attracted to the anode (+) and hydrogen ions are attracted to the cathode (−).

Prior art systems and methods for dissociating hydrogen from water molecules tend to be relatively inefficient and consume more energy than can be recaptured. Therefore, it would be desirable to have an improved hydrogen generation system that consumes less energy than conventional approaches to hydrogen generation. In some cases, supplementing electrolysis with a 10-MHz hybrid sound wave may benefit hydrogen production. See, e.g., newatlas.com/energy/hydrogen-sound-vibration-electrolysis, which is incorporated by reference. That approach used gold electrodes and an electrolyte with a neutral pH level contained in a glass electrolyte chamber. See also, 13 Advanced Energy Materials 7, Feb. 17, 2023—onlinelibrary.wiley.com/doi/10.1002/aenm.202203164, which is also incorporated by reference.

Against this background, it would be beneficial to make hydrogen on-demand practically from an abundant fuel—water—without resorting to solar power or wind energy.

Among the patent references considered before filing this patent application are: EP2433902, EP3907181, PE20211530, US2012/0222954, US2017/0275160, and US2020/0376459.

SUMMARY

In light of the shortcomings and challenges presented by the prior art, it is an object of the present disclosure to provide an improved hydrogen generation system. This disclosure aims to provide relatively inexpensive, energy-efficient green hydrogen by exposing an electrolyte to vibration and a direct electric current. In one embodiment, green hydrogen is created through electrolysis. This involves splitting water molecules into hydrogen and oxygen. Bach gas is attracted to a different electrode, where the hydrogen can be captured from the cathode, compressed, and stored.

Green hydrogen enables zero-emission fuel to be made, allowing refueling to be done relatively quickly.

In one approach according to this disclosure, electrolysis occurs under the influence of vibrational energy. Without being bound by any particular theory, vibrating water molecules has the effect of "frustrating" the water molecules nearest to the electrodes, shaking them out of the tetrahedral networks they tend to settle in. This results in more "free" water molecules that can contact electrode catalytic sites. newatlas.com/energy/hydrogen-sound-vibration-electrolysis. Preferably, the electrodes are comprised of a relatively inexpensive material. In one case, the preferred material is stainless steel.

Thus, several aspects of this disclosure involve a system and method of making hydrogen from water that circulates along a tortuous path within a reaction vessel under the influences of electrolysis and vibration.

The generally cylindrical reaction vessel has an outer shell, a central shaft, and one or more concentric inner tubes separated by annular spaces. Water is delivered to the annular spaces under the influence of a pump through an inlet in communication with the central shaft. Water flows along a tortuous flow path. That path begins at an inner annular space around the central shaft and ends at an outer annular space beneath the outer shell. Reaction products, including hydrogen, water, water vapor, and oxygen emerge from the reaction vessel through an outlet associated with a manifold positioned at the end of the reaction vessel.

A vibratory excitation device such as a variable frequency drive or controller imparts a high-frequency vibratory stimulus to the concentric tubes in the reaction vessel and water as it wends its way along the tortuous flow path. As a result, water molecules are dissociated into hydrogen and oxygen. These reaction products are delivered through an exit port in the reaction vessel along a delivery conduit to a receiving reservoir.

Some of the potential and actual uses of hydrogen include hydrogen engines that power generators, vehicles powered by hydrogen, and hydrogen fueling stations.

1. Hydrogen Engines that Power Generators

A hydrogen engine can be connected to a generator to create electricity. If, for example, electrical energy is delivered to a reaction vessel containing water flowing along a tortuous path, hydrogen can be produced. That hydrogen can be delivered to a hydrogen engine. This may allow electricity to be delivered to remote places that are not connected to electric power grids.

At the end of December 2022, the United States had about 205 operating fuel cell electric power generators at 147 facilities with about 350 megawatts (MW) of total nameplate electric generation capacity. www.eia.gov/energyexplained/hydrogen/use-of-hydrogen.php

2. Vehicles Powered by Hydrogen

One or more embodiments of the disclosed system could be designed into the structure of a truck. This would allow trucks to travel from coast to coast without stopping for fuel, and be environmentally clean. Some vehicle designs contemplate hydrogen production on demand. This avoids storing and delivering hydrogen on the vehicle or at fueling stations.

Several vehicle manufacturers (e.g., Toyota and Hyundai) have developed hydrogen engines to power vehicles. Vehicle availability is limited to locations with adequate hydrogen refueling stations.

The cost of fuel cells and the limited availability of hydrogen fueling stations limit the number of hydrogen-fueled vehicles in use. The consumer won't buy those vehicles if hydrogen refueling stations are inaccessible. Companies won't build refueling stations if they don't have customers with hydrogen-fueled vehicles.

3. Hydrogen Fueling Stations

The United States has about 56 hydrogen-vehicle-fueling stations. All are in California. afdc.energy.gov/stations/#/find/nearest?fuel=HY&lpg_secondary=true&country=US&hy_nonretail=true. California's Advanced Clean Cars Program provides assistance in establishing publicly accessible hydrogen vehicle fueling stations to promote a market for zero-emission vehicles.

The US Government projects the need for 50,000 hydrogen fueling stations in the US and will fund them. www.eia.gov/energyexplained/hydrogen/use-of-hydrogen.php. Each fueling station could have one or two embodiments of the disclosed system. This would provide an unlimited and continuous supply of inexpensive hydrogen.

BRIEF DESCRIPTION OF THE DRAWINGS

The disclosure and its advantages appear in greater detail in the context of the following description of embodiments given by way of illustration and with reference to the accompanying Figures, in which.

DETAILED DESCRIPTION

Figure 1:
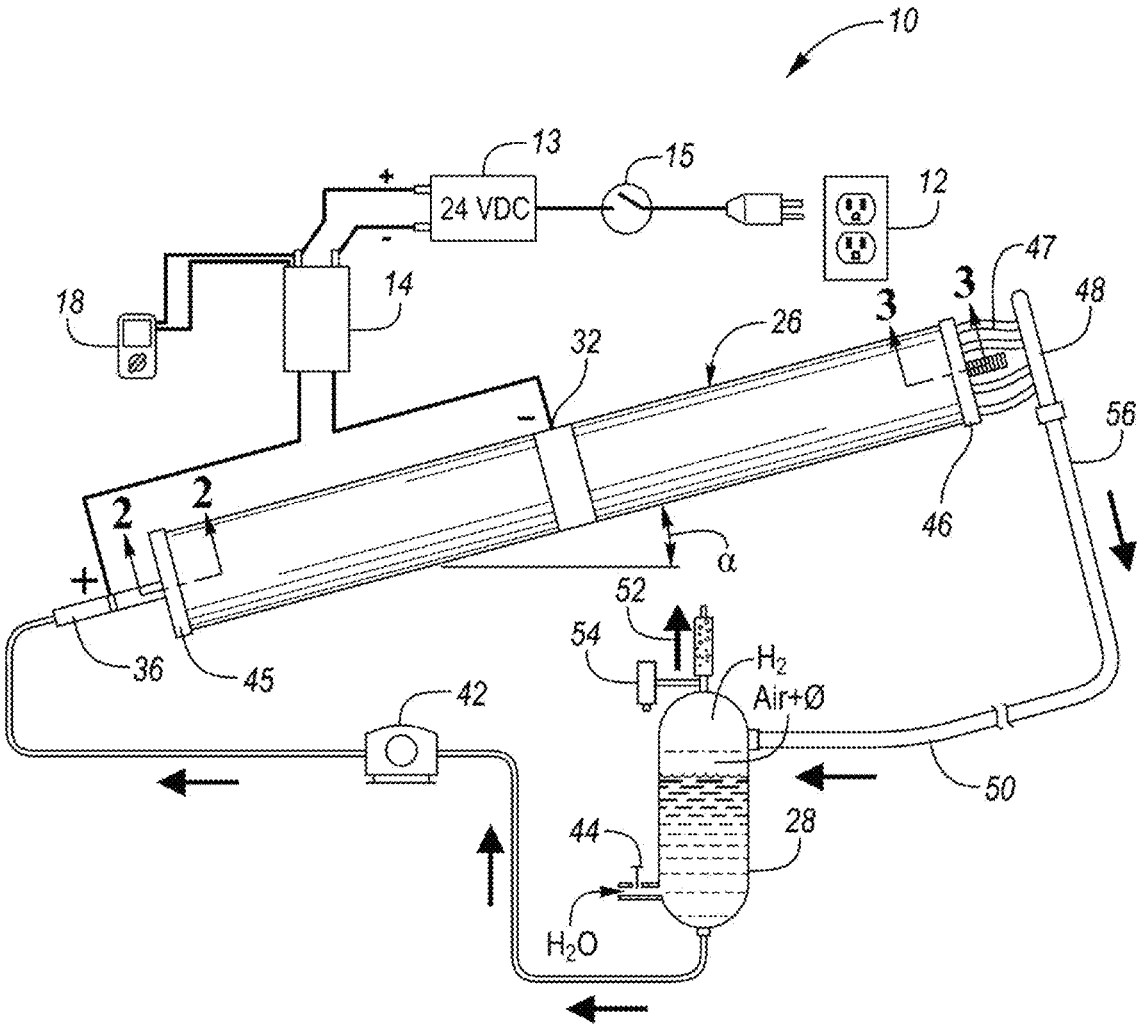
FIG. 1 shows a representative arrangement of electrically and fluidly connected components that comprise one embodiment of a system for making hydrogen according to the present disclosure.

As required, detailed embodiments of the present invention are disclosed herein; however, it is understood that the disclosed embodiments are merely exemplary. They may be embodied in various and alternative forms. The Figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the disclosed method and system.

Elements that are present in more than one of the Figures are given the same reference numerals in each of them.

FIG. 1 is a schematic diagram of a representative system (10) for making hydrogen on demand according to the disclosure.

One or more power outlets (12) provide a source of AC power to a power converter (13) via a switch (15) and to a vibratory excitation means such as a variable frequency drive or controller (14). In one embodiment, there is a 120-volt AC power supply (12) that delivers electrical energy to the power converter (13) when the switch (15) is closed. One suitable converter is the Mean Well Model SE-1000-24. It converts an input of 120 volts AC to about 17.5 amps and delivers an output of 24 volts.

In alternative embodiments, other voltages (e.g., 240 volts) may be supplied. Further, in other embodiments, electrical energy may be provided by battery power.

Examples of a vibratory excitation means (14) is a variable frequency drive or controller or a modulator. A preferred embodiment has an operating frequency of 18 kHz. If a modulator is used, an operating frequency range is up to 1 kHz. A preferred embodiment of a modulator is a pulse width modulator. Some variable frequency drives include a pulse width modulator. In one example, a suitable frequency lies between 40 Hz and 100 Hz.

A personal computer, laptop, notebook, tablet, and the like (collectively, "microprocessor"), in communication with the control pad (18) allows adjustments to be made that influence the frequency and current delivered to the reaction vessel (26). The control pad (18) is used to enter variables and values into the variable frequency drive (14) that controls the resulting vibration characteristics and displays the results. The control pad (18) could be operated wirelessly via Bluetooth if desired.

If desired, but not depicted, ban inductor (e.g., a high current 450-amp inductor from Coil Winding Specialist, Orange Grove, CA—www.coilws.com), a potentiometer (e.g., B5k), and a capacitor (e.g., 75 volt Cornell Dublilier 176719) are connected to the variable frequency drive (14).

The vibratory excitation means (14) communicates to the reaction vessel (26) a vibratory signal that causes vibration in the concentric tubes (30) of the reaction vessel (26) and its water contents. In some cases, harmonics are thereby created with good results.

As shown in FIG. 1, the pressure vessel (28) receives influent water through a spigot (44), which occupies about half of the pressure vessel's volume. Optionally, a water filter (not shown) may be provided upstream of the spigot (44). Air and oxygen are held above the water. Hydrogen produced by the system lies above the air and oxygen. The pressure vessel (28) delivers effluent water to the reaction vessel (26), optionally through a water pump (e.g., 120 AC, 1/25 HP) (42).

Figure 2:
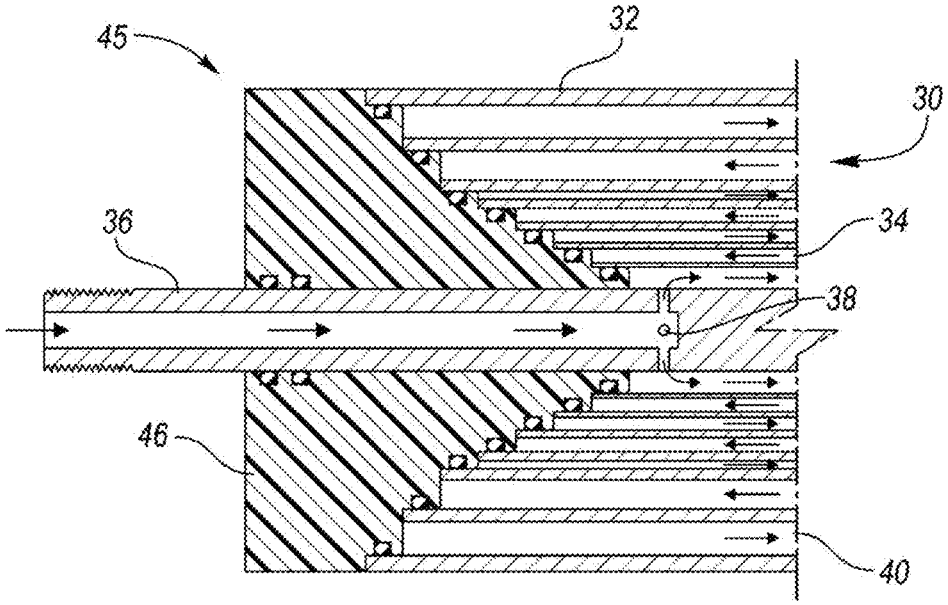
FIG. 2 represents the upstream end of the reaction vessel taken along the line 2-2 of FIG. 1.
Figure 3:
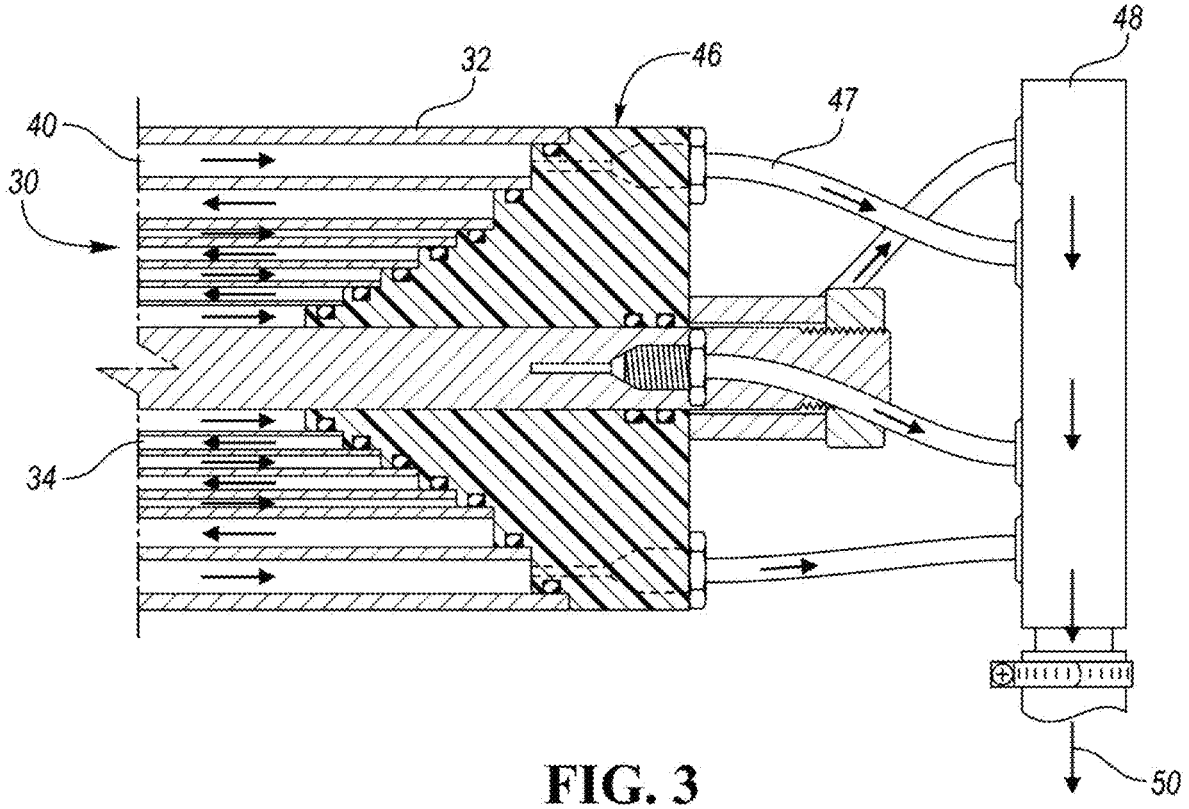
FIG. 3 represents the downstream end of the reaction vessel taken along the line 3-3 of FIG. 1.
Figure 4:
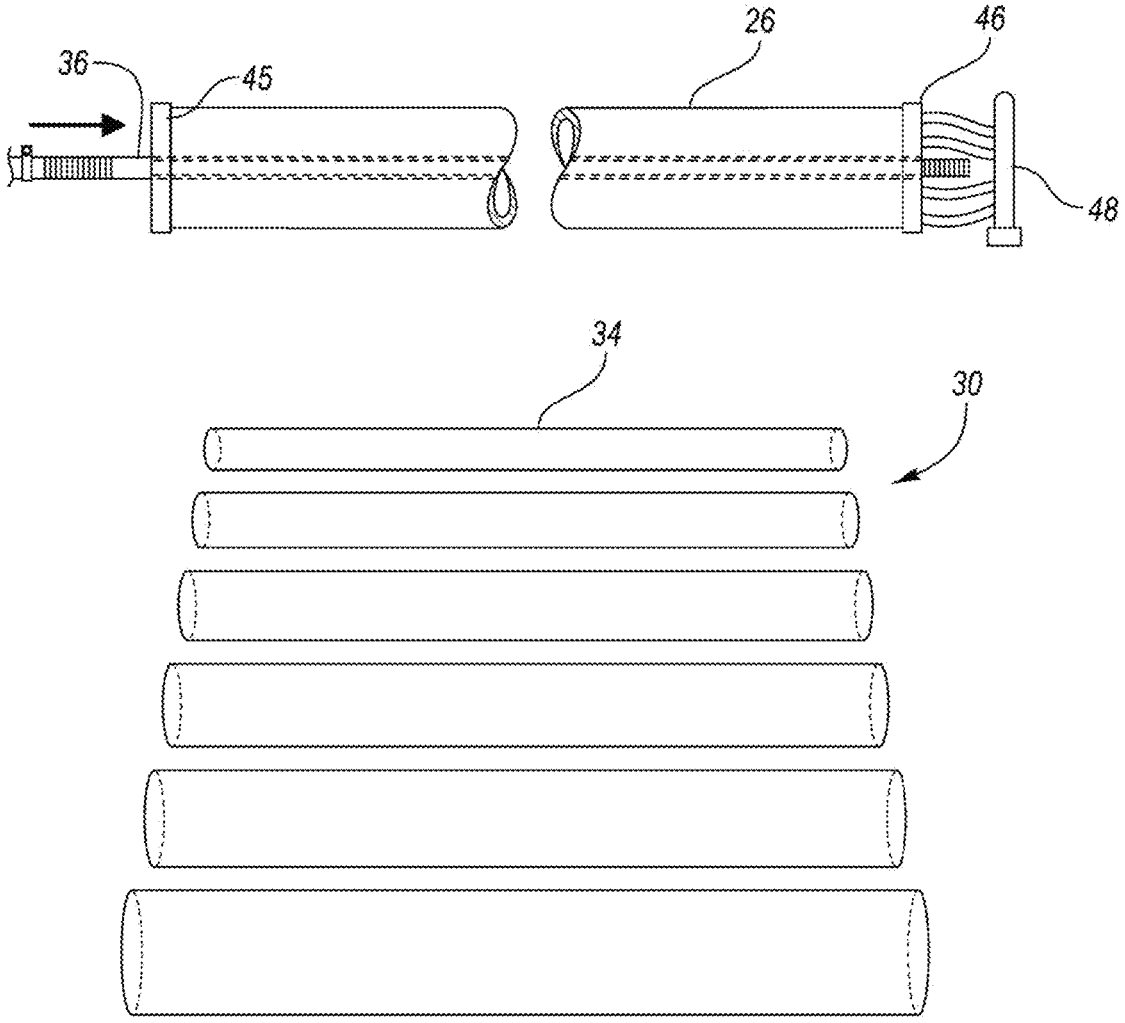
FIG. 4 is an exploded view of concentric tubes before assembly into the reaction vessel.

The reaction vessel (26) includes concentric tubes (30) (FIGS. 2-4). A cross-section of the reaction vessel (26) and concentric tubes (30) appears in FIGS. 2-3. Preferably the tubes (30) are made of stainless steel. In some embodiments, six seven-foot-long tubes are deployed (FIG. 4). An outer tube (32) has a relatively thick wall. Inner tubes (34) have thinner walls. A hollow central shaft (36) is provided. In some embodiments, the central shaft (36) is also made of stainless steel.

The end caps (45, 46) are preferably made of nylon. Serving as relatively inexpensive electrodes, the concentric tubes (30) and outer shell (32) are made from stainless steel. The hollow central shaft (36) has threads at each end which hold the stainless steel thin-walled tubes (30) between the end caps (45, 46). In one exemplary embodiment, the reaction vessel (26) is about 4 feet long.

In the reaction vessel (26), water flows into the hollow central shaft (36), outwardly through orifices (38) provided along at least some of its length, and then along annular spaces (40) between the concentric tubes (30) via a tortuous path. The water partly re-circulates within the reaction vessel (26) by flowing back and forth. In some embodiments, this occurs about 3-4 times. Water flows from smaller (inner) tubes to larger (outer) tubes. In alternative embodiments, water can instead enter at an outer annular space and tortuously flow inwardly towards the central shaft. By flowing from the smaller inner annular spaces towards the outer tube (32), volumetric expansion of the gas/water mixture is accommodated.

If desired the reaction vessel (26) may be oriented at an angle ($\alpha$) as shown in FIG. 1, or vertically or horizontally if desired. In practice, 15 degrees<=($\alpha$)<=90 degrees. Without being bound by a particular theory, an inclined orientation is believed to use gravity to good effect. Water tends to accumulate toward the inlet side (45) of the reaction vessel (26), and less dense gases and vapors tend to migrate toward its upper end (46).

As noted earlier, a water pump (42) may lie between the pressure vessel (28) and the reaction vessel (26). Optionally, the water pump (42) may resemble a 1/25 HP circulating pump. If desired, a flow meter (52) and valve (54) may be provided in communication with one or more gaseous effluents. A suitable flow meter is offered by Dwyer.

Water plus impurities/catalyst(s) serve as an electrolytic medium. Preferably, an electrolyte such as sodium hydroxide is added. Thus, impurities and ions in the water enable conduction.

If desired, influent water passes through a reverse osmosis unit (not shown) for cleansing before entry into the pressure vessel (28). Optionally, the pressure vessel (28) may be a 9-gallon stainless steel pressure tank.

Non-conductive baffles or end caps (45, 46) are arranged between the concentric inner tubes (30). Consequently, the tortuous fluid flow path includes a first flow direction along the inner annular space, an opposite direction of flow in the adjacent annular outer space, and so on until the outer shell (32) is reached.

A liquid/gas effluent mixture from the reaction vessel (26) flows from outer annular spaces through conduits (47) to a manifold (48). Optionally there are four such conduits (47). Effluent reaction products pass from the manifold (48) to the pressure vessel (14) via a delivery conduit (56). This thus results in an on-demand hydrogen delivery system that may or may not store green hydrogen before use.

Preferably, a direct current runs from the power converter (13) to a positive terminal of the variable frequency drive (14) and then to a positive terminal attached to the central shaft (36) of the reaction vessel (26) (FIG. 1). A direct current runs between a negative terminal of the variable frequency drive (14) and the outer tube electrode (32) of the reaction vessel (26). The output current (voltage varies based on throttle setting communicated to the control pad/microprocessor (18) runs from the variable frequency drive (14) to the central inner shaft (36) optionally via an inductor (not depicted), which may store at least some of the electrical energy.

As a result, the inner shaft (36) and concentric tubes (30) vibrate and subject the water to electrolysis and vibratory disturbance, which in some cases is a harmonic frequency. Without being bound to a particular theory, when the water and tubes are forced into resonant vibrations at one of their natural frequencies, they vibrate so that a standing wave pattern is formed within the water. These patterns are only created at specific frequencies of vibration, termed "harmonic frequencies", or merely harmonics. TPC Physics Tutorial: Fundamental Frequency and Harmonics (physicsclassroom.com).

In response to vibratory disturbance and electrolysis, water molecules ($H_2O$) within stainless steel electrodes (32, 36) are split into hydrogen and oxygen. Clean end-products, including green hydrogen (50), are produced practically, efficiently, and economically.

Noteworthy is that no hydrogen need be stored long-term in a desired use environment. This avoids the storage problems described above. Unless otherwise deployed, oxygen gas is allowed to escape to an ambient atmosphere through a port associated with the flow meter (52).

Wastage is minimized because the water flowing from the reaction vessel (26) can be re-circulated.

As noted earlier, green hydrogen gas may be connected, for example, to a hydrogen motor that turns a generator to supply electricity or to a fuel cell generator. There are no adverse emissions. The hydrogen could be made on demand. Accordingly, no storage is needed. If, for example, 5 L per minute is needed for a small motor to generate electricity for a house, then all that is needed is a relatively small system. If 40 L per minute is needed to power a semi-tractor-trailer rig, then one might use larger systems. Again, hydrogen storage is not required. All the operator needs to do is make what he needs, on demand.

To recap, a tortuous electrolyte flow within the reaction vessel while subjected to vibratory stimulus and electrolysis combine to create a suitable environment for inexpensive, high-yield hydrogen production without harmful emissions.

Naturally, the present disclosure is subject to numerous variations as regards its implementation. Although several embodiments are described above, it should readily be understood that it is not conceivable to identify all possible embodiments exhaustively. It is naturally possible to replace any of the means described with equivalent means without going beyond the ambit of the present disclosure and the claims.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

TABLE OF REFERENCE NUMERALS

| Reference No. | Component |
|---|---|
| 10 | System For Making Green Hydrogen |
| 12 | AC Power Source |
| 13 | Power Converter |
| 14 | Variable Frequency Drive |
| 15 | Switch |
| 18 | Microprocessor and Control Pad |
| 26 | Reaction Vessel |
| 28 | Pressure Vessel |
| 30 | Concentric Tubes |
| 32 | Outer Tube Electrode |
| 34 | Inner Tubes |
| 36 | Hollow Central Shaft Electrode |
| 38 | Orifices |
| 40 | Annular Spaces |
| 42 | Water Pump |
| 44 | Spigot |
| 45, 46 | Baffles (Non-Conductive End Caps) |
| 47 | Conduits |
| 48 | Manifold |
| 52 | Flow Meter |
| 54 | Valve |
| 56 | Hydrogen Delivery Conduit |

What is claimed is:

1. A system for generating hydrogen, comprising:

a reaction vessel having an outer shell, a central shaft, and one or more concentric inner tubes separated by annular spaces, wherein the annular spaces define a flow path within the reaction vessel, wherein the flow path constrains an aqueous solution to circulate within the annular spaces beginning at an inner annular space around the central shaft and ending at an outer annular space beneath the outer shell, and wherein the central shaft and the outer shell serve as electrodes;

a pump configured to pump an aqueous solution to the reaction vessel; and a power converter in communication with a source of alternating current and configured to convert the alternating current to direct current, wherein the power converter is electrically connected to the electrodes and is configured to pass a current through the aqueous solution via the electrodes so that at least some molecules within the aqueous solution dissociate into hydrogen and oxygen.

2. The system of claim 1, wherein the aqueous solution comprises an electrolyte.

3. The system of claim 1, further comprising a pressure vessel in fluid communication with the reaction vessel, wherein the aqueous solution is stored in the pressure vessel prior to being delivered to the reaction vessel.

4. The system of claim 1, wherein the reaction vessel comprises at least six concentric inner tubes.

5. The system of claim 1, wherein the reaction vessel further comprises end caps holding the outer shell, the central shaft, and the one or more concentric inner tubes in place, and wherein the end caps are positioned on both ends of the reaction vessel.

6. The system of claim 5, wherein the end caps include a non-conductive material.

7. The system of claim 1, wherein the flow path comprises a first flow direction along the inner annular space and opposite flow directions in adjacent annular spaces.

8. The system of claim 1, wherein the reaction vessel is inclined at an angle relative to a horizontal reference line, where the angle is between 15 degrees and 90 degrees.

9. The system of claim 1, wherein at least one of the outer shell, the central shaft, and the one or more concentric inner tubes includes stainless steel.

* * * * *